US008259980B2

(12) United States Patent
Maurer et al.

(10) Patent No.: US 8,259,980 B2
(45) Date of Patent: Sep. 4, 2012

(54) PIVOTAL SPEAKER TWEETER

(75) Inventors: Ronald D. Maurer, Carlsbad, CA (US); Sean P. McDermott, El Cajon, CA (US); Richard P. Apgar, Lakeside, CA (US)

(73) Assignee: Three Amigos LLC, El Cajon, CA (US)

( * ) Notice: Subject to any disclaimer, the term of this patent is extended or adjusted under 35 U.S.C. 154(b) by 1038 days.

(21) Appl. No.: 12/199,395

(22) Filed: Aug. 27, 2008

(65) Prior Publication Data

US 2010/0054522 A1 Mar. 4, 2010

(51) Int. Cl.
*H04R 1/02* (2006.01)
*H04R 9/06* (2006.01)

(52) U.S. Cl. ..... 381/336; 381/387; 381/395; 181/153; 181/199

(58) Field of Classification Search ..... 381/387, 381/336, 395; 181/153, 199
See application file for complete search history.

(56) References Cited

U.S. PATENT DOCUMENTS

| | | | | |
|---|---|---|---|---|
| 3,720,787 | A * | 3/1973 | Ishii et al. | 381/336 |
| 4,182,429 | A * | 1/1980 | Senzaki | 181/144 |
| 4,811,406 | A * | 3/1989 | Kawachi | 381/186 |
| 4,917,212 | A * | 4/1990 | Iwaya | 181/141 |
| 5,319,164 | A | 6/1994 | Shen | |
| 5,635,686 | A | 6/1997 | Fenton | |
| 6,002,780 | A * | 12/1999 | Espiritu | 381/182 |
| 6,101,262 | A | 8/2000 | Haase et al. | |
| 6,282,297 | B1 | 8/2001 | Lin | |
| 6,356,640 | B1 * | 3/2002 | Lin | 381/182 |
| 6,683,963 | B2 * | 1/2004 | Sterns et al. | 381/182 |
| 6,766,027 | B2 * | 7/2004 | Ryan et al. | 381/182 |
| 6,792,125 | B1 | 9/2004 | David et al. | |
| 6,876,752 | B1 * | 4/2005 | Guenther | 381/386 |
| 7,178,628 | B2 * | 2/2007 | Gordon | 181/153 |
| D559,835 | S | 1/2008 | Marshall | |
| 7,970,149 | B2 * | 6/2011 | Reardon et al. | 381/87 |
| 7,997,381 | B2 * | 8/2011 | Gordon | 181/150 |
| 8,014,554 | B2 * | 9/2011 | Xu et al. | 381/386 |
| 8,023,683 | B2 * | 9/2011 | Lin | 381/387 |
| 2003/0044039 | A1 * | 3/2003 | Sterns et al. | 381/386 |
| 2003/0123684 | A1 | 7/2003 | Call, II et al. | |
| 2004/0042627 | A1 * | 3/2004 | Ryan et al. | 381/182 |
| 2005/0123156 | A1 * | 6/2005 | Wright et al. | 381/182 |
| 2005/0224281 | A1 | 10/2005 | Gordon | |
| 2007/0144825 | A1 | 6/2007 | Gordon | |
| 2008/0199037 | A1 * | 8/2008 | Xu et al. | 381/387 |
| 2009/0074225 | A1 * | 3/2009 | Lin | 381/387 |
| 2009/0279732 | A1 * | 11/2009 | Maurer et al. | 381/387 |
| 2010/0040254 | A1 * | 2/2010 | Wright | 381/395 |
| 2010/0054522 | A1 * | 3/2010 | Maurer et al. | 381/387 |
| 2010/0322457 | A1 * | 12/2010 | Gladwin et al. | 381/395 |

FOREIGN PATENT DOCUMENTS

GB 2 328 108 A * 2/1999

* cited by examiner

*Primary Examiner* — Mary Wilczewski
(74) *Attorney, Agent, or Firm* — McKee, Voorhees & Sease, P.L.C.

(57) ABSTRACT

An adjustable tweeter assembly is provided to allow a tweeter to be directionally oriented to a selected position. The assembly includes a base, a bowl, and a cup, which are nested together so that the bowl is sandwiched between the base and the cup for movement therebetween. The tweeter is mounted in the bowl which can be rotated and pivoted relative to the cup and to the base. A fastener extends through the cup, the bowl, and the base, and through a leaf spring so as to provide a compressive or clamping force between the base, the bowl, and the cup. The tweeter is rotatable 360° and pivotal approximately 90°.

19 Claims, 6 Drawing Sheets

PIVOTAL SPEAKER TWEETER

FIELD OF THE INVENTION

The present invention relates generally to an audio speaker tweeter that is pivotally mounted in a housing for directional adjustability.

BACKGROUND OF THE INVENTION

Modern sound systems are often designed with speakers mounted flush with a wall, ceiling or other surface. To achieve this, the speaker assembly must be recessed within the wall, ceiling or panel, thereby providing a preferred aesthetic appearance. The early ceiling speakers had a fixed orientation such that the woofer and tweeter pointed substantially straight downwardly or outwardly. More recent, speakers have been designed with the pivotal and swivel components for directional adjustment of the woofer and/or tweeter. The orientation of such adjustable speakers generally is maintained by pressure between the components, which often are made of plastic. However, recessed speakers do not provide the full range of motion to direct sound from the speaker to a specific area. The various types of pressure couplings differ in the effort or force required to adjust the speaker to the desired position. These pressure fit components do not allow for adjustment of the tension during manufacturing or in the field during installation. Some prior art adjustable speakers also use a pivot mechanism similar to a ball joint or fulcrum. Some prior art pivot mechanisms include a lock for setting a speaker in a preferred position. However, these locks have a tendency to become loose over time due to vibration from the speaker and/or from changes in temperature or humidity. For example, ceiling speakers often are installed with the upper or rear portion exposed to the attic, which may have extreme temperature and humidity swings which create further problems, since the plastic components are hydroscopic. Some speaker applications have additional vibrations, such as automobiles, trucks, boats, and aircraft, due to the movement of the vehicle along the road, through the water, or in the air. Such exterior vibrations also eventually lead to loosening of the prior art pivot mechanisms for the speakers, which then move from the desired directional setting. Also, as the locking member is loosened, the speaker may move out of position, or an undesirable buzzing or rattling sound may occur, distorting the sound quality. Another problem with prior art adjustable speakers is limited rotation due to internal connecting wires.

Accordingly, a primary objective of the present invention is the provision of an improved speaker assembly having directional adjustability which can be quickly and easily set and maintained.

A further objective of the present invention is the provision of a speaker tweeter assembly which may be finely adjusted during the assembly and/or installation process.

A further objective of this invention is the provision of directionally adjustable tweeter assembly, which is maintained in position by friction.

Still another objective of the present invention is the provision of a pivotal tweeter speaker which is economical to manufacture.

Yet another objective of the present invention is the provision of an improved pivotal tweeter assembly which maintains a selective directional orientation throughout use.

A further objective of the present invention is the provision of an improved pivotal tweeter which provides optimum sound quality without deterioration or distortion over time.

These and other objectives will become apparent from the following description of the invention.

SUMMARY OF THE INVENTION

Panel mounted speakers according to the present invention may use either a single speaker, or a woofer and tweeter combination. The present invention is specifically directed towards a tweeter which is independently pivotal relative to the woofer so as to have independent directional adjustability.

In the preferred embodiment, the tweeter is mounted to a bowl which is nested or sandwiched between a curved base and a curved cup so as to be pivotally and rotationally supported therebetween. A leaf spring may be provided to provide a constant force to eliminate vibration of the assembly.

DETAILED DESCRIPTION OF THE DRAWINGS

Figure 1:
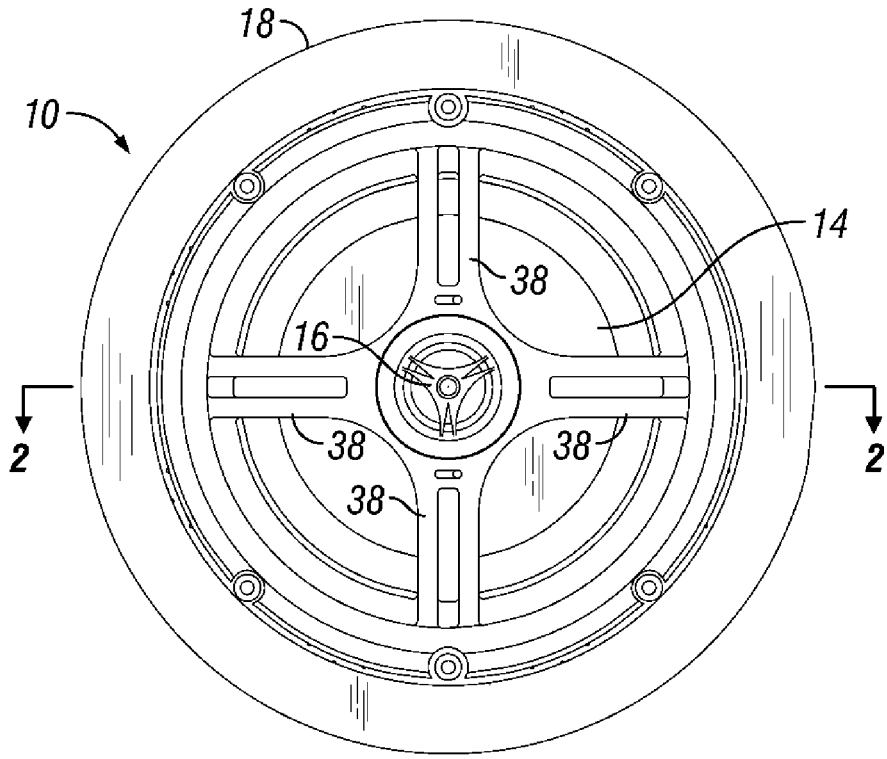
FIG. 1 is a front view of a speaker assembly having the adjustable tweeter of the present invention.
Figure 2:
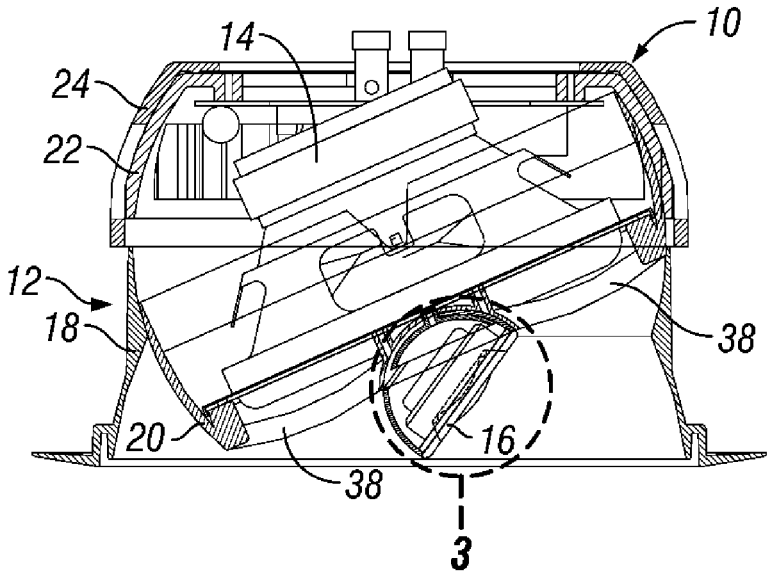
FIG. 2 is a sectional view of the assembly shown in FIG. 1.

In one embodiment, a speaker assembly with the pivoting tweeter of the present invention is generally designated in the drawings by the reference numeral 10. The assembly 10 includes a housing 12, a woofer or driver 14, and a tweeter 16. The housing 12 is designed to allow the driver 14 to be tilted and rotated about a center axis of the housing. The housing 12 includes four primary components, the baffle 18, the swivel 20, the swivel cup 22, and the retainer 24. The driver 14 and tweeter 16 are mounted in the swivel 20. The housing 12 is described in Applicant's co-pending application, U.S. Ser. No. 61/051,027 filed May 7, 2008.

Figure 3:
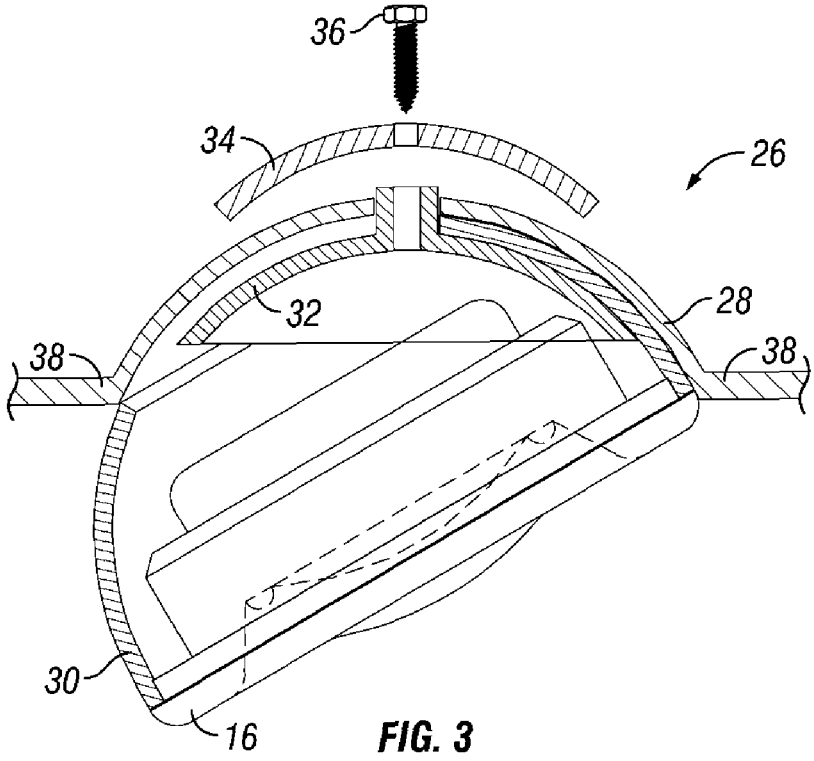
FIG. 3 is an enlarged sectional view of the tweeter assembly of the present invention taken along line 3-3 of FIG. 2, with the tweeter adjusted to a pivoted orientation.
Figure 4:
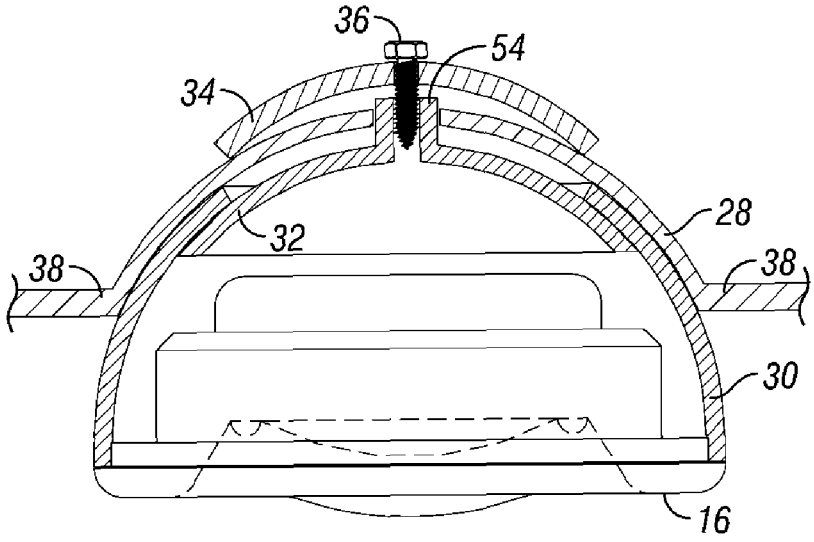
FIG. 4 a view similar to FIG. 3 showing the tweeter in a centered orientation.
Figure 6:
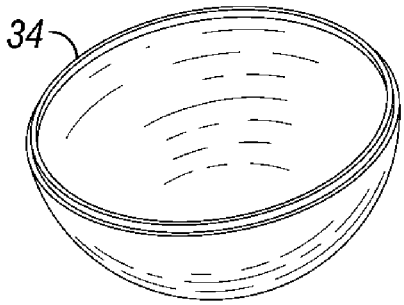
FIG. 6 is a perspective view of the leaf spring.
Figure 7:
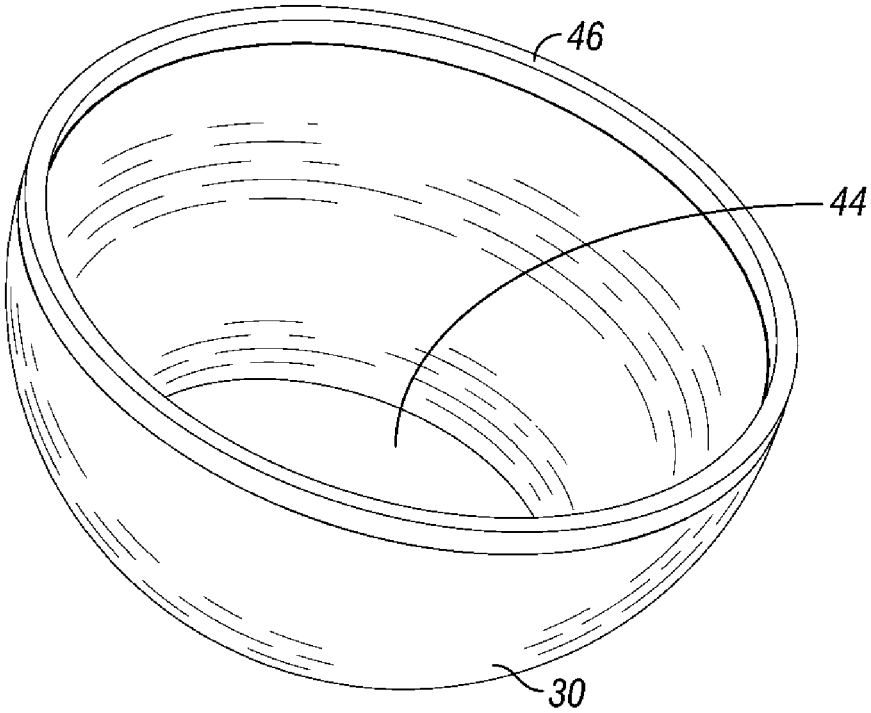
FIG. 7 is a perspective view of the tweeter mounting bowl.
Figure 8:
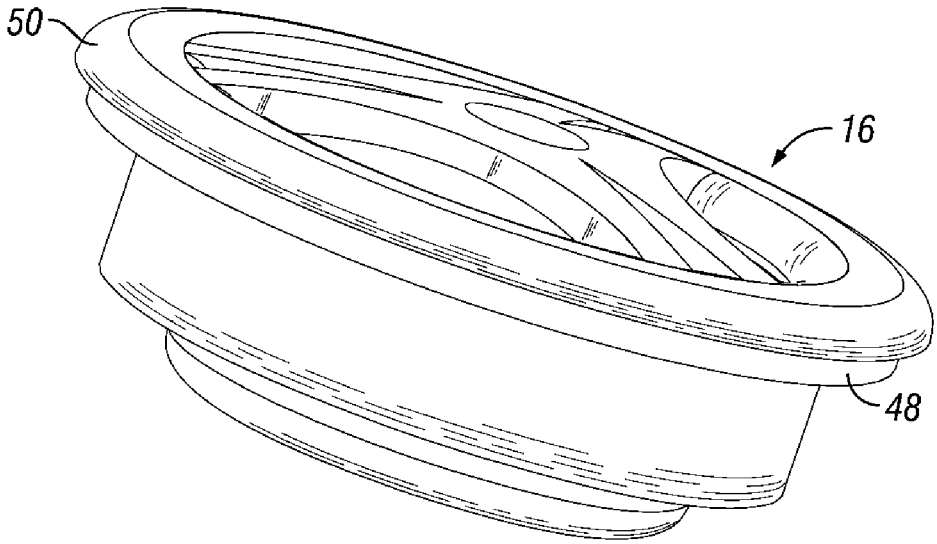
FIG. 8 is a perspective view of the tweeter.
Figure 9:
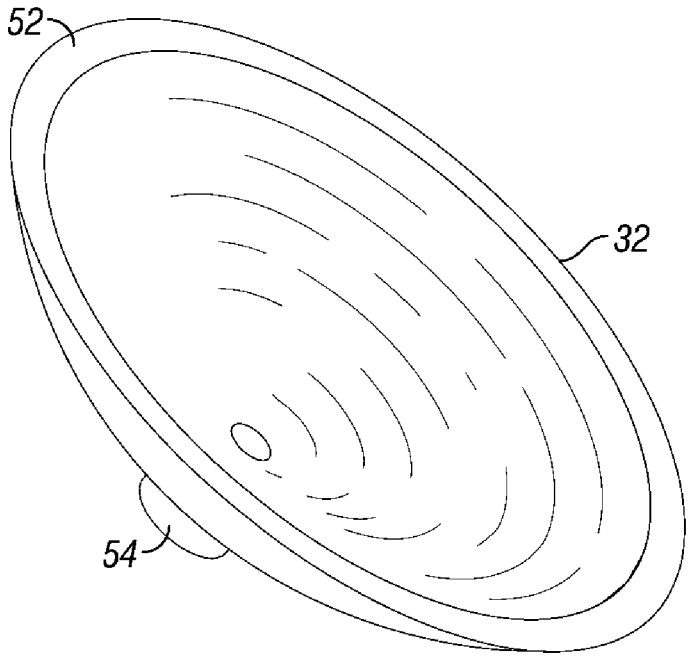
FIG. 9 is a perspective view of the tweeter base.
Figure 10:
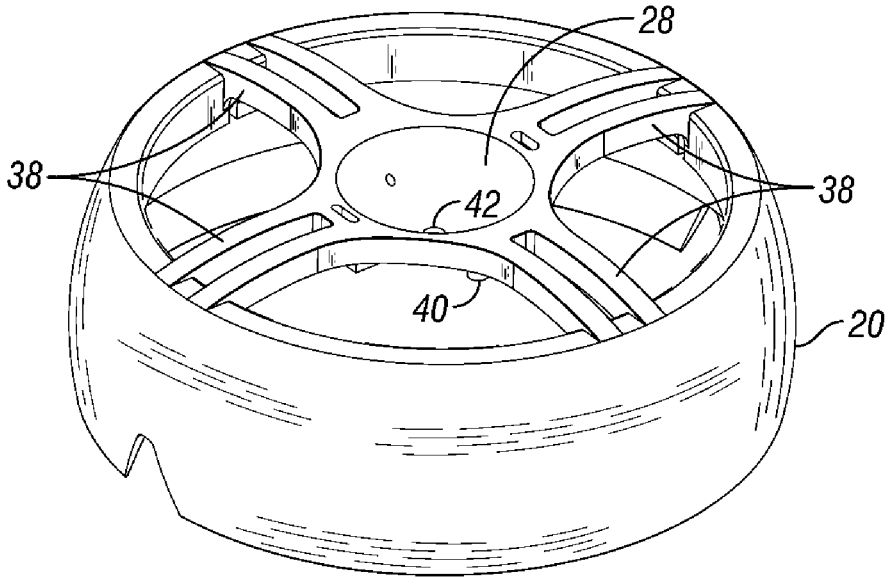
FIG. 10 is a perspective view of the mounting cup.
Figure 11:
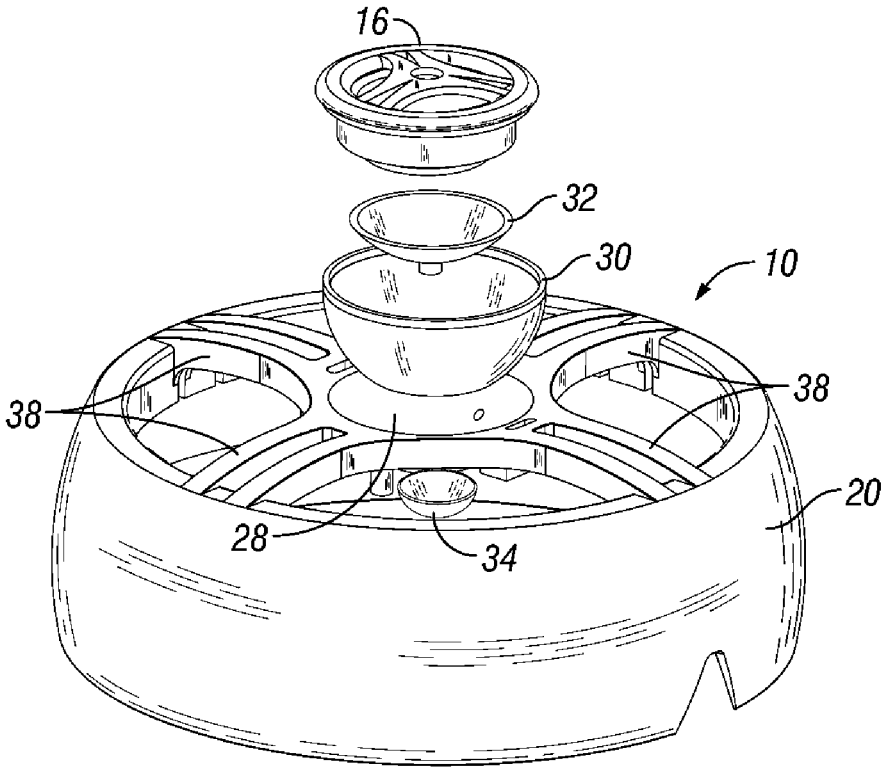
FIG. 11 is an exploded perspective view of the tweeter assembly components.

The present invention is directed towards an assembly 26 for pivotally mounting the tweeter 16 in the housing 12 or in a conventional ceiling or wall mounted speaker assembly having a fixed, non-pivoting driver. The pivoting tweeter of the present invention can also be used in conventional floor standing speakers or shelf speakers having cabinets, as well as outdoor speakers. As shown in FIGS. 3 and 4, the tweeter assembly 26 includes a base 28, a mounting bowl 30, a cup 32, and a spring 34. FIGS. 6 and 11 show exploded views of the assembly 26.

The tweeter base 28, bowl 30, and cup 32 each have the general shape of a section of a sphere, with the base 28, bowl 30, and cup 32 having successively smaller diameters, respectively. Thus, the base 28, bowl 30, and cup 32 are designed to nest together with the bowl 30 sandwiched between the base 28 and the cup 32.

In the speaker assembly 10 shown in the drawings, base 28 is integrally formed with the swivel 20 and centrally supported by a plurality of spokes 38. A hole 42 extends through the center of the base 28.

The bowl 30 has an enlarged opening 44 in the bottom of the bowl 30. The upper perimeter edge 46 of the bowl 30 matingly receives the tweeter 16, with the tweeter 16 secured to the bowl by adhesive, through a friction fit, or other convenient means of securement. In particular, the tweeter 16 has a shoulder 48 which is received within the perimeter edge 46 of the bowl 30. An outer flange 50 on the tweeter 16 engages the perimeter edge 46 of the bowl 30.

The cup 32 has a perimeter edge 52 with a diameter greater than the diameter of the opening 44 in the bowl 30. Thus, the cup 32 mounts within the bowl 30, without passing therethrough. A centered boss 54 extends rearwardly from the outer convex surface of the cup 32 and through the hole 42 of the base 28, as best seen in FIGS. 3 and 4.

Figure 5:
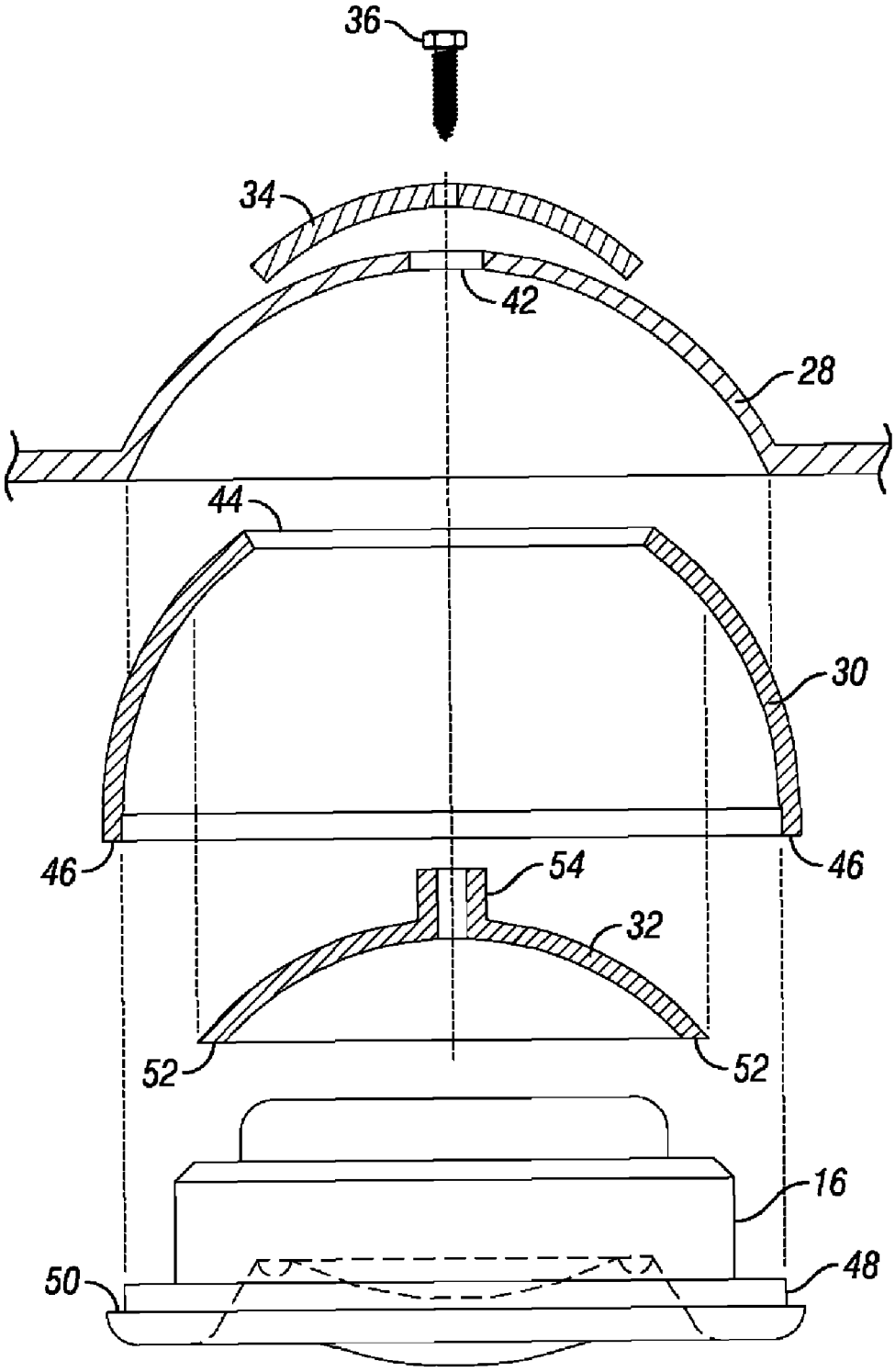
FIG. 5 is an exploded sectional view of the components of the tweeter assembly.

In a preferred embodiment, a leaf spring 34 is mounted to the base 28 by a fastener 36, such a self-tapping screw, extends through the hole of the boss 54, the hole 42 of the base 28, and the leaf spring 34, as seen in FIG. 5, so as to secure the components of the tweeter assembly 26 together. The spring 34 is in the form of a small cup with a radius of curvature slightly less than the curvature of the base 28, so that only the perimeter edge of the cup 34 engages the base 28 and the center of the spring cup 34 is spaced from the base 28. The fastener 36 provides a compressive force between the base 28, bowl 30, cup 32, and leaf spring 34, while allowing the bowl 32 to pivot and rotate between the base 28 and the cup 32. For example, FIG. 4 shows the bowl 30 and tweeter 16 in a centered orientation relative to the base 28 and the cup 32, whereas FIG. 3 shows the bowl 30 and tweeter 16 in an angular position relative to the base 28 and cup 32. The base 28 and cup 32 are fixed relative to one another. The opening 44 in the bowl 30 defines the limits of the pivoting action of the tweeter 16, when the edge of the opening 44 engages the boss 54 of the cup 32, as seen in FIG. 3.

It is understood that the spring 34 may have forms other than the cup shown in the drawings. For example, a leaf spring plate having opposite ends fixed to the base and a center spaced from the base 28 can be used. In an alternative embodiment, the leaf spring 34 can be eliminated, with the cup 32 bolted to the base 28 so as to provide the appropriate frictional force between the base 28, bowl 30, and cup 32 so as to maintain the bowl 30 and tweeter 16 in a selected position.

The tweeter assembly 26 allows for accurate positioning of the tweeter 16 towards a listening area, without having a diffracted edge, such that the sound emanating from the tweeter 16 is not reflected or distorted. Thus, the tweeter assembly 26 provides superior sonic performance compared to prior art pivotal tweeters. The tweeter assembly 26 also allows for more precise aiming of the tweeter 16 to the listening area within a room, with a fine degree of adjustability during the manufacturing process and in the field during installation of the speaker assembly 10. The bowl 30 is rotatable 360° between the base 28 and the cup 32. The bowl 30 is also pivotal approximately 45° on either side of the centered position shown in FIG. 4, for a total 90° pivotal range. The movement of the bowl 30 between the base 28 and the cup 30 is smooth and fluid, without being too tight so as to make movement difficult, or too loose so that the position cannot be maintained throughout use. The leaf spring 34 eliminates the need for a locking mechanism, as in the prior art, and provides sufficient tension so that the selected position of the tweeter 16 is maintained. This firm tensioning of the tweeter assembly 26 to the baffle 18 of the speaker assembly 10 provides improved audio performance, which does not deteriorate over time due to vibrations, temperature changes, or humidity changes.

The speaker assembly 26 can be used in numerous environments, including ceilings and walls in a room, as well as in vehicles such as RVs, boats, automobiles, and aircraft. The vibrations of such vehicles do not affect the positioning of the tweeter 16 due to the clamping action of the base 28, bowl 30, cup 32, and leaf spring 34.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An adjustable tweeter assembly comprising:

a base;

a bowl residing in the base and having an open front end and tapering to an open rear end;

a cup residing in the bowl and having a diameter larger than the open rear end of the bowl;

the cup, bowl and base of the bowl being secured in a nested arrangement with the bowl sandwiched between the base and the cup for movement there between;

a tweeter mounted in the front end of the bowl; and the bowl and the cup each have spherical profiles such that the bowl may be pivoted and rotated relative to the base and the cup.

2. The assembly of claim 1 further comprising a fastener extending through the base, bowl and cup to secure the base, bowl and cup together.

3. The assembly of claim 2 further comprising a leaf spring through which the fastener extends to provide a compressive force between the base, the bowl and the cup.

4. The assembly of claim 2 wherein the spring provides a tensile force on the fastener.

5. The assembly of claim 1 wherein the base and the cup are fixed relative to one another.

6. The assembly of claim 1 wherein the cup has a center extension extending through the rear end of the bowl to limit movement of the bowl.

7. The assembly of claim 1 wherein the tweeter is rotatable 360° and pivotal through a range of approximately 90° with respect to the base.

8. A directionally adjustable assembly for a tweeter speaker, the assembly comprising:

a dome shaped base defining inner and outer surfaces, and a hole through the apex of the base;

a dome-shaped bowl defining inner and outer surfaces, with the outer surface of the bowl matingly engaging the inner surface of the base, and having a rear opening and a front perimeter edge;

a dome-shaped cup defining inner and outer surfaces, with the outer surface matingly engaging the inner surface of the bowl;

a fastener clamping the base, bowl and cup together while allowing the bowl to be adjustably positioned relative to the base and to the cup; and a tweeter mounted to the perimeter edge of the bowl.

9. The assembly of claim 8 wherein the base, the bowl and the cup have progressively smaller diameters.

10. The assembly of claim 8 wherein the diameter of the cup is greater than the diameter of the rear opening of the bowl.

11. The assembly of claim 8 wherein the cup has a boss extending rearwardly through the opening in the bowl to limit movement of the bowl relative to the base.

12. The assembly of claim 8 further comprising a leaf spring through which the fastener extends to provide a compressive force between the base, the bowl and the cup.

13. The assembly of claim 12 wherein the spring provides a tensile force on the fastener.

14. The assembly of claim 12 wherein the leaf spring resides behind the base.

15. The assembly of claim 8 wherein the base, the bowl and the cup each have spherical profiles such that the bowl may be pivoted and rotated relative to the base and the cup.

16. The assembly of claim 8 wherein the base and the cup are fixed relative to one another.

17. The assembly of claim 8 wherein the bowl is both pivotal and rotatable between the base and the cup.

18. The assembly of claim 8 wherein the bowl is rotatable 360° relative to the base.

19. The assembly of claim 8 wherein the bowl is pivoted substantially 90° relative to the base.

* * * * *